US008991554B2

(12) United States Patent
Podzimek

(10) Patent No.: US 8,991,554 B2
(45) Date of Patent: Mar. 31, 2015

(54) MECHANIC'S LEANING DEVICE

(76) Inventor: Dennis A. Podzimek, Yorkville, IL (US)

( * ) Notice: Subject to any disclaimer, the term of this patent is extended or adjusted under 35 U.S.C. 154(b) by 136 days.

(21) Appl. No.: 13/524,166

(22) Filed: Jun. 15, 2012

(65) Prior Publication Data

US 2012/0325584 A1 Dec. 27, 2012

Related U.S. Application Data

(60) Provisional application No. 61/500,412, filed on Jun. 23, 2011.

(51) Int. Cl.

| | |
|---|---|
| ***E04G 1/00*** | (2006.01) |
| ***E04G 3/00*** | (2006.01) |
| ***E04G 5/00*** | (2006.01) |
| ***E04G 7/00*** | (2006.01) |
| ***B25H 5/00*** | (2006.01) |
| ***A47C 9/00*** | (2006.01) |

(52) U.S. Cl.

CPC . *B25H 5/00* (2013.01); *A47C 9/005* (2013.01)
USPC ..... 182/132

(58) Field of Classification Search

CPC ..... B25H 5/00; E04G 1/28; A47C 9/005
USPC ..... 182/116, 129, 132; 297/423.11, 423.12, 297/423.13
See application file for complete search history.

(56) References Cited

U.S. PATENT DOCUMENTS

| | | | | |
|---|---|---|---|---|
| 2,701,168 | A | 2/1955 | Schemers | |
| 2,969,123 | A * | 1/1961 | Jamerson et al. | 182/116 |
| 3,976,155 | A | 8/1976 | Esch | |
| 4,072,209 | A | 2/1978 | Bolis | |
| 4,397,374 | A | 8/1983 | Rumage et al. | |
| 4,530,419 | A | 7/1985 | Rumage et al. | |
| 4,650,249 | A | 3/1987 | Serber | |
| 4,727,958 | A | 3/1988 | Botello | |
| 4,867,273 | A * | 9/1989 | Schaevitz | 182/116 |
| 5,181,681 | A | 1/1993 | Edwards | |
| 5,669,463 | A | 9/1997 | Robertson | |
| 5,899,297 | A | 5/1999 | Clark | |
| 6,010,187 | A | 1/2000 | Dallas et al. | |
| 6,105,719 | A * | 8/2000 | Lensing | 182/116 |
| 6,540,301 | B1 | 4/2003 | Bottoms | |
| 6,595,590 | B2 * | 7/2003 | Bottoms | 297/423.11 |
| 6,824,149 | B1 * | 11/2004 | Whitlock et al. | 280/32.6 |
| 6,883,793 | B2 | 4/2005 | Fortin et al. | |
| 6,926,365 | B2 * | 8/2005 | Bottoms | 297/423.12 |
| 6,957,718 | B1 * | 10/2005 | Whiteside et al. | 182/115 |
| 7,080,715 | B1 * | 7/2006 | Bowlin | 182/129 |
| 7,320,502 | B1 | 1/2008 | McCloskey | |
| 7,678,033 | B2 * | 3/2010 | Tyree | 482/137 |
| D635,690 | S * | 4/2011 | Casella | D25/64 |
| 8,496,292 | B2 * | 7/2013 | Strassberg | 297/195.11 |
| 2012/0061179 | A1 * | 3/2012 | English | 182/121 |

FOREIGN PATENT DOCUMENTS

WO WO 2007/066067 6/2007

* cited by examiner

*Primary Examiner* — Katherine Mitchell
*Assistant Examiner* — Shiref Mekhaeil
(74) *Attorney, Agent, or Firm* — Pauley Petersen & Erickson

(57) ABSTRACT

A mechanic's leaning device includes a base, an upper torso support having an adjustable first height above the base, and a combination step and knee support having an adjustable second height above the base which is less than and adjustable relative to the first height. The mechanic's leaning device can be used by mechanics of all sizes for working on a wide variety of vehicles, ranging from very small to very large.

9 Claims, 2 Drawing Sheets

MECHANIC'S LEANING DEVICE

RELATED APPLICATIONS

This patent application claims priority to U.S. Provisional Application Ser. No. 61/500,412, filed on Jun. 23, 2011, the disclosure of which is incorporated by reference.

FIELD OF THE INVENTION

This invention is directed to a mechanic's leaning device that can be used by mechanics of different sizes to work on vehicles having a wide range of different sizes.

BACKGROUND OF THE INVENTION

Mechanic's leaning devices are known which include an upper torso support at a first height and a knee support at a second height that is lower than the first height. The mechanic typically lean over the upper torso support while kneeling on the knee support in order to work inside the hood of a vehicle. In some leaning devices, the distance between the upper torso support and the knee support can be lengthened or shortened in order to provide comfortable working postures for mechanics of different sizes.

Conventional mechanic's leaning devices are typically useful for working on either relatively smaller vehicles, or relatively larger vehicles, but not both. For instance, mechanic's leaning device useful for working on sedans may not have the flexibility to enable work on large sport utility vehicles. With the increasing popularity of vehicle sizes ranging from very small to very large, there is a need or desire for a mechanic's leaning device that has sufficient adjustment flexibility to serve a wide variety of vehicle sizes.

SUMMARY OF THE INVENTION

The present invention is directed to a mechanic's leaning device having a wide range of height adjustment. The leaning device includes a base having a length and a width, two side beams laterally adjacent to the base and having lengths exceeding the length of the base, an upright frame having an adjustable height, an upper torso support mounted to the upright frame and positioned at an adjustable first height above the base, a combination step and knee support mounted to the upright frame at an adjustable second height above the base which is less than and adjustable relative to the first height, and a mechanism on or mounted to the frame for receiving the combination step and knee support at the adjustable second height. The combination step and knee support may include a kneeler pad removably mounted to the step to enable use as a kneeler when the pad is mounted, or a step when the pad is removed.

By providing an adjustable frame height, an adjustable first height for the upper torso support, and an adjustable second height for the combination step and knee support which is less than and adjustable relative to the first height, the adjustment range is maximized. The mechanic's leaning device can be used for working on a wide range of vehicle sizes ranging from small compact cars to large sport utility vehicles, and can be comfortably used by mechanics of varying sizes. The mechanism for receiving the combination step and knee support at the adjustable second height above the platform enables the leaning device to be easily mounted for use with small, large, or intermediate sized vehicles. The combination step and knee support can be mounted as a knee support for small and mid-sized vehicles and as a step for large vehicles that require upper torso support high above the base.

The base suitably includes a platform that can be used for standing. The platform enables the leaning device to be used with or without the combination step and knee support for tasks which require only upper torso support.

With the foregoing in mind, it is a feature and advantage of the invention to provide a mechanic's leaning device having a wider range of flexibility than conventional leaning devices, which can be used for repair and/or maintenance of vehicles of widely varying sizes and by mechanics of widely varying sizes.

The foregoing and other features and advantages will be further apparent from the following detailed description of the invention, read in conjunction with the drawings. The detailed description and drawings are illustrative rather than limiting, the scope of the invention being defined by the appended claims and equivalents thereof.

DETAILED DESCRIPTION OF THE PREFERRED EMBODIMENTS

Figure 1:
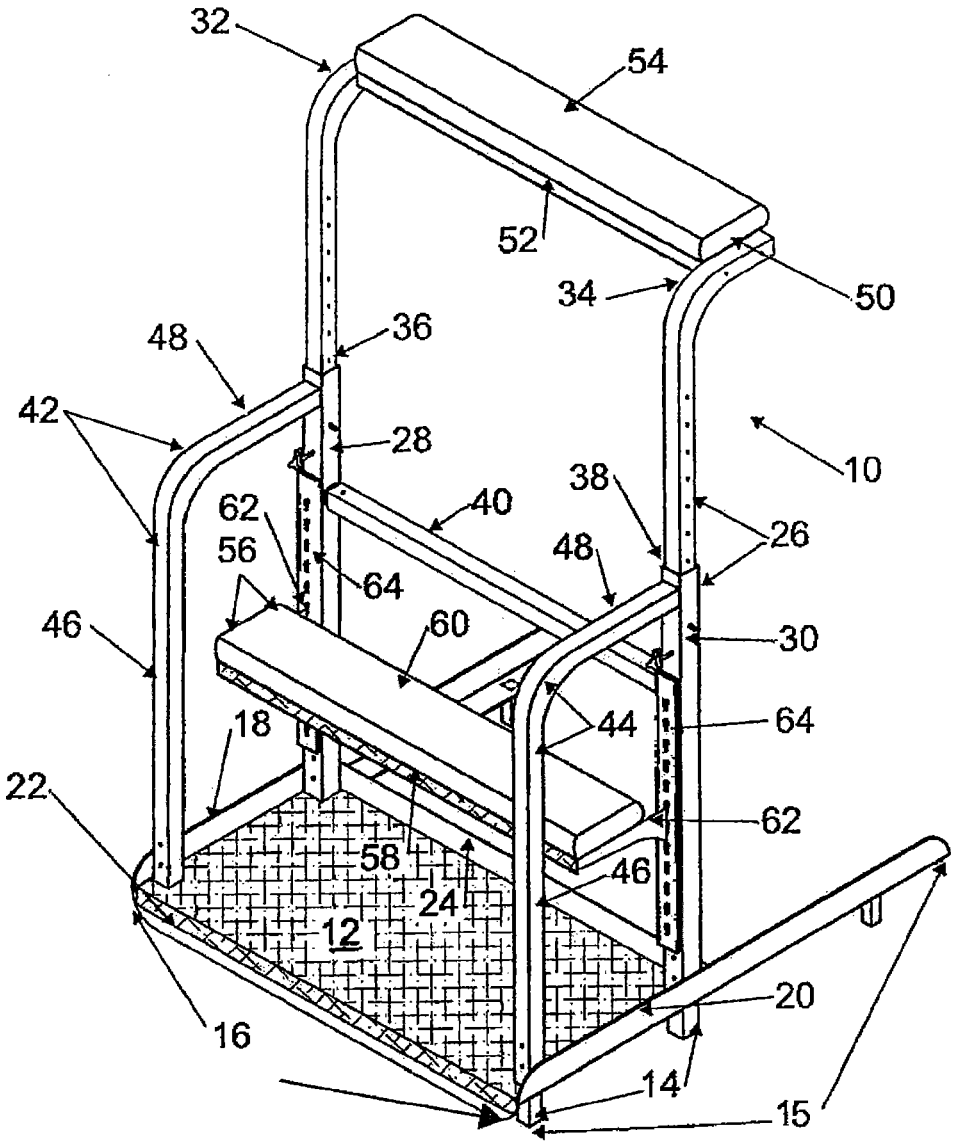
FIG. 1 is a perspective view of a mechanic's leaning device of the invention.
Figure 2:
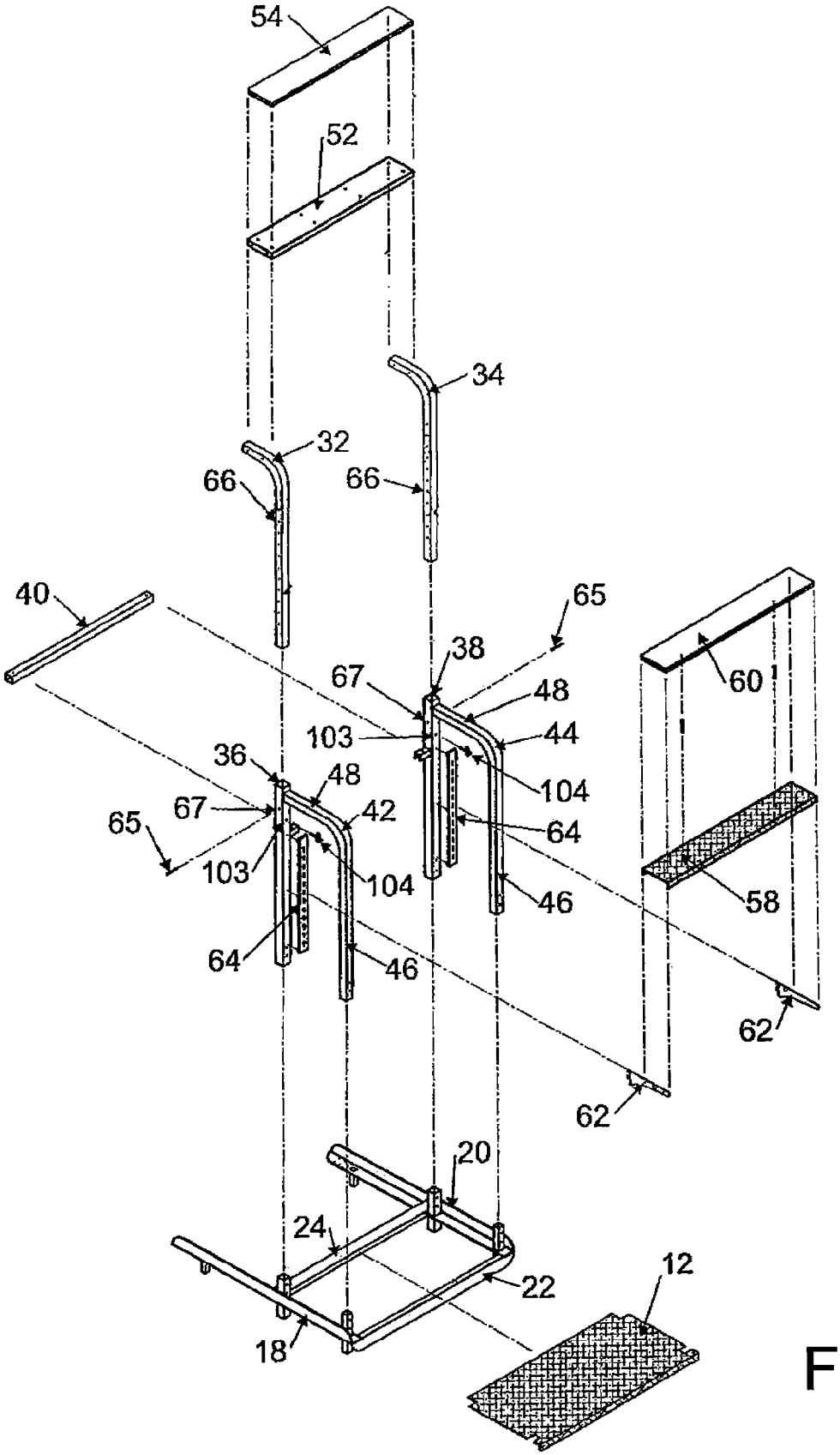
FIG. 2 is an exploded view of the mechanic's leaning device of FIG. 1.

Referring to FIGS. 1 and 2, a mechanic's leaning device 10 of the invention includes a base 12 having a length 14 and a width 16. The base 12 can be a platform as shown, and is surrounded on its edges by two side beams 18 and 20, front beam 22, and back beam 24. The side beams 18 and 20 each have a length 15 exceeding the length 14 of the base 12, suitably at least double the length 14 of the base 12. The portions of side beams 18 and 20 that extend beyond the base 12 are positioned underneath a vehicle during use, and prevent the leaning device 10 from tipping forward when a user leans forward to work on a vehicle. The leaning device 10 can be positioned either along the front of a vehicle, with the side beams 18 and 20 extending underneath the radiator, or along the side of a vehicle, with the side beams 18 and 20 straddling one of the wheels of the vehicle. The front and back beams 22 and 24 suitably have lengths about equal to the width 16 of base 12.

An upright frame 26 having an adjustable height is mounted to the base 12 and/or side beams 18 and 20, in the vicinity of the four corners of the base 12. The upright frame includes a fixed upright portion that may include two fixed upright beams 28 and 30 mounted to one or both of the base 12 and side beams 18 and 20, and an adjustable upright portion that may include two adjustable upright beams 32 and 34 mounted to the fixed upright beams 28 and 30, respectively, and adjustable relative to the fixed upright beams.

In one embodiment, the adjustable upright beams 32 and 34 are received in hollow openings 36 and 38 in the fixed upright beams 28 and 30, and slidably engage the fixed upright beams 28 and 30. The upright frame 26 may also include a plurality of stabilizing beams that stabilize the position of fixed upright beams 28 and 30. The stabilizing beams may include a cross beam 40 extending between and secured to the fixed upright beams 28 and 30, and side rails 42 and 44 extending between and attached to the fixed upright beams 28 and 30 and the respective side beams 18 and 20. Each side rail 42 and 44 may include an upright portion 46 substantially parallel to the fixed upright beams 28 and 30, and an arm portion 48 substantially parallel to the side beams 18 and 20.

An upper torso support 50 is mounted to the upright frame 26, suitably at a top end of the adjustable upright beams 32 and 34, at an adjustable first height above the base 12. The upper torso support 50 may include a platform 52 mounted to a top end of the upright frame 26 and a pad 54 mounted to the platform 52. The first height of the upper torso support 50 can be adjustable by virtue of the fact that the upright beams 32 and 34 are adjustable relative to the fixed upright beams 28 and 30.

A combination step and knee support 56 is mounted to the upright frame 26 at an adjustable second height above the base 12. The adjustable second height is less than the adjustable first height and is independently adjustable relative to the adjustable first height. The combination step and knee support 56 may include a step 58 and a removable kneeler pad 60 mounted to the step 58 using bolts and wing nuts, or another suitable connection mechanism. The combination 56 can be mounted to the upright frame 26 using mounting brackets 62 that connect to or form part of, and extend from step 58. The mounting brackets 62 may interlock the fixed upright beams 28 and 30 using pins that secure through mounting slots 64 positioned at selected different heights on the fixed upright beams 28 and 30. Suitably, at least four, or at least seven, or at least ten of the mounting slots 64 are positioned at different heights on the fixed upright beams 28 and 30 to enable positioning the combination step and knee support 56 at several different second heights above the base 12.

In the illustrated embodiment, the adjustable upright beams 32 and 34 also include a plurality of side mounting holes 66 which can align with a guide hole 67 on each of the fixed upright beams 28 and 30. By aligning different ones of mounting holes 66 with guide hole 67, the upper torso support 50 can be mounted at different first heights. A mounting pin 65 passes through each guide hole 67 and aligned mounting hole 66 to fix the position of upper torso support 50 at a selected height. Moreover, each fixed upright beam 28 and 30 includes a welded nut 103 mounted to a front opening (not shown). Each welded nut 103 receives a star bolt 104 which can be hand tightened to stabilize the upper torso support 50 at the selected first height. The upper torso support 50 can thus be raised or lowered without having to remove the combination step and knee support 56 from the upright frame 26.

Due to the wide variety of adjustment heights for the upper torso support, and the combination step and knee support, the mechanic's leaning device of the invention is useful for working on a wide variety of vehicle sizes, and can be used by a wide variety of mechanics. Typically, the mechanic's leaning device is designed so that a user can stand on the platform 12 (without combination step and knee support 56) to work on any vehicle, or kneel on the kneeler 60 to work on cars and small sports utility vehicles, or stand on the step 58 to work on trucks and large sports utility vehicles. The construction of the leaning device is relatively inexpensive, yet highly versatile.

The embodiments of the invention disclosed herein are presently preferred. Various improvements and modifications can be made without departing from the spirit and scope of the invention. The scope of the invention is indicated by the appended claims. All changes that fall within the meaning and range of equivalents are intended to be embraced therein.

I claim:

1. A mechanic's leaning device, comprising:

a base standing platform having a length and a width;

two side beams laterally adjacent and parallel to the length of the base standing platform and having lengths exceeding the length of the base standing platform, the base standing platform extending between and engaging both of the side beams;

front and back beams adjacent and parallel to the width of the base standing platform, the base standing platform extending between and engaging the front and back beams;

an adjustable upright frame including a plurality of fixed upright beams mounted to at least one of the base standing platform and side beams and a plurality of adjustable upright beams mounted to the fixed upright beams;

an upper torso support mounted to the plurality of adjustable upright beams of the upright frame and positioned at an adjustable first height above the base standing platform; and a combination step and knee support mounted to the plurality of fixed upright beams of the upright frame, the combination step and knee support being mounted at an adjustable second height above the base standing platform which is lower than the first height and independently adjustable relative to the first height;

wherein each of the adjustable upright beams includes a first set of plurality of mounting slots at different heights above the base standing platform; and wherein the adjustable frame is telescopically adjustable by the first set of plurality of mounting slots;

the combination step and knee support includes mounting brackets that interlock the fixed upright beams at the second height above the base standing platform and extend over the base standing platform, a step mounted to the brackets and extending over the base standing platform, and a kneeler pad mounted to the step, wherein the step is mounted to a second set of plurality of slots on the fixed upright beams via the mounting brackets; wherein the combination step and knee support is adjusted at the second height by the second set of plurality of slots.

2. The mechanic's leaning device of claim 1, wherein the front and back beams extend between the side beams.

3. The mechanic's leaning device of claim 1, wherein the upright frame comprises:

a cross beam extending between and secured to the fixed upright beams; and side rails extending between and attached to the fixed upright beams and the side beams.

4. The mechanic's leaning device of claim 3, each side rail including an upright portion substantially parallel to the fixed upright beams and an arm portion substantially parallel to the side beams.

5. The mechanic's leaning device of claim 3, wherein the upper torso support comprises a platform mounted to the adjustable upright beams and a pad mounted to the platform.

6. The mechanic's leaning device of claim 3, wherein the adjustable upright beams enable adjustment of the upper torso support without requiring removal of the combination step and knee support.

7. The mechanic's leaning device of claim 1, wherein the adjustable upright beams are telescopically received by the fixed upright beams and slidably engage the fixed upright beams.

8. The mechanic's leaning device of claim 1, wherein the upper torso support comprises a platform mounted to a top of the upright frame and a pad mounted to the platform.

9. The mechanic's leaning device of claim 1, wherein the upright frame further comprises side rails extending between the side beams and the fixed upright beams of the upright frame.

* * * * *